United States Patent [19]

Schlicher

[11] 4,041,564

[45] Aug. 16, 1977

[54] COMBINATION SCRAPER AND BRUSH WITH EXTENSIBLE HANDLE

[75] Inventor: Charles W. Schlicher, Wichita, Kans.

[73] Assignee: S/V Tool Company, Inc., Newton, Kans.

[21] Appl. No.: 660,420

[22] Filed: Feb. 23, 1976

[51] Int. Cl.[2] ..... A46B 17/08; A47L 1/10

[52] U.S. Cl. ..... 15/111; 15/144 B; 15/202

[58] Field of Search ..... 15/111, 113, 117, 143 B, 15/144 B, 184, 201, 202

[56] References Cited

U.S. PATENT DOCUMENTS

| | | | |
|---|---|---|---|
| 1,713,274 | 5/1929 | Fitzgerald | 15/202 UX |
| 2,682,072 | 6/1954 | Green | 15/111 X |
| 2,896,241 | 7/1959 | Cotman | 15/111 X |
| 3,036,322 | 5/1962 | Jorgensen | 15/111 |
| 3,278,965 | 10/1966 | Frazier | 15/184 |

FOREIGN PATENT DOCUMENTS

| | | | |
|---|---|---|---|
| 245,696 | 4/1912 | Germany | 15/111 |

*Primary Examiner*—Daniel Blum

*Attorney, Agent, or Firm*—Schmidt, Johnson, Hovey & Williams

[57] ABSTRACT

An extensible scraping and brushing tool for use in removing ice and snow from vehicle windows or the like has an elongate handle provided with a scraper member at one end and has a brush assembly that is telescopically received in the handle. The brush assembly is nested in the handle when the tool is to be used as a scraper or as a brush of a relatively short length or, the brush assembly may be extended from such a first position to a second position in which the brush assembly extends beyond the handle in order that the tool may be used as a brush having an extended reach. Guide structure for reciprocably shifting the brush assembly and retaining the same in connection with the handle is formed integrally as a part of the handle and brush assembly and is of a configuration providing a relatively high degree of rigidity at the point of connection between the two when the tool is in its extended condition. The brush assembly and the handle are so constructed that the complete tool may be assembled by press-fitting the components together, eliminating the need for fasteners or other special assembly procedures.

4 Claims, 7 Drawing Figures

COMBINATION SCRAPER AND BRUSH WITH EXTENSIBLE HANDLE

This invention relates to a tool of the kind employed to remove ice and snow from vehicle windows or the like.

Various gadgets have been made available that are useful only for scraping frozen snow and ice from a window but do not have any provision for brushing unfrozen powdery or loose material from the vehicle. Other attempts to solve the problem of removing ice and snow from vehicle windows have been in the form of elongate devices that have an ice scraper on one end and a fixed brush secured to the opposite end. These devices have proved impractical and less than desirable in that they are quite long and rather awkward to handle. First of all, their length is such that they do not readily fit into the vehicle glove compartment and, consequently, must be stored elsewhere in the vehicle, such as beneath the seat, along the rear window ledge, or in the trunk compartment. Thus, these devices frequently are in the way, become broken, or are unhandy to get at when needed.

Secondly, these relatively long devices are quite susceptible to breakage in that the forces exerted thereon, particularly when used to scrape ice, causes the device to twist and, because of its length, be easily broken. Also, cold temperatures tend to make the device brittle when made of plastic material, plastic being most freqeuntly used because of cost and ease of fabrication, therefore increasing the likelihood of breakage. The length of these brushing and scraping devices is necessary in order that the same can be most effectively used in reaching toward the center of the vehicle for either scraping or brushing purposes without the user having to lean over the automobile and come into contact with the snow and ice thereon, or brush against the dirty surface of the vehicle.

It is therefore a very important object of my invention to provide a combination scraping and brushing tool having an extensible handle in which the overall length is relatively short when the tool is used as a scraper or is in storage and which may be lengthened during use as a brush.

It is another very important object of the instant invention to provide a scraping and brushing tool that is so constructed as to have sufficient strength to resist breakage during periods of use as an ice scraoer and when in its extended condition, particularly in extreme cold temperatures.

Yet another significant object of the invention is to provide a snow and ice removal tool having a construction that affords its greatest strength at the points of highest stress during use either as a brush or as a scraper.

Still another object of the invention is to provide a combination scraper and brush tool with an extensible handle in which the components may be assembled by way of snap-fit construction and thus eliminate the need for fasteners.

Figures 1, 2, 3, 4, 5, 6, 7:
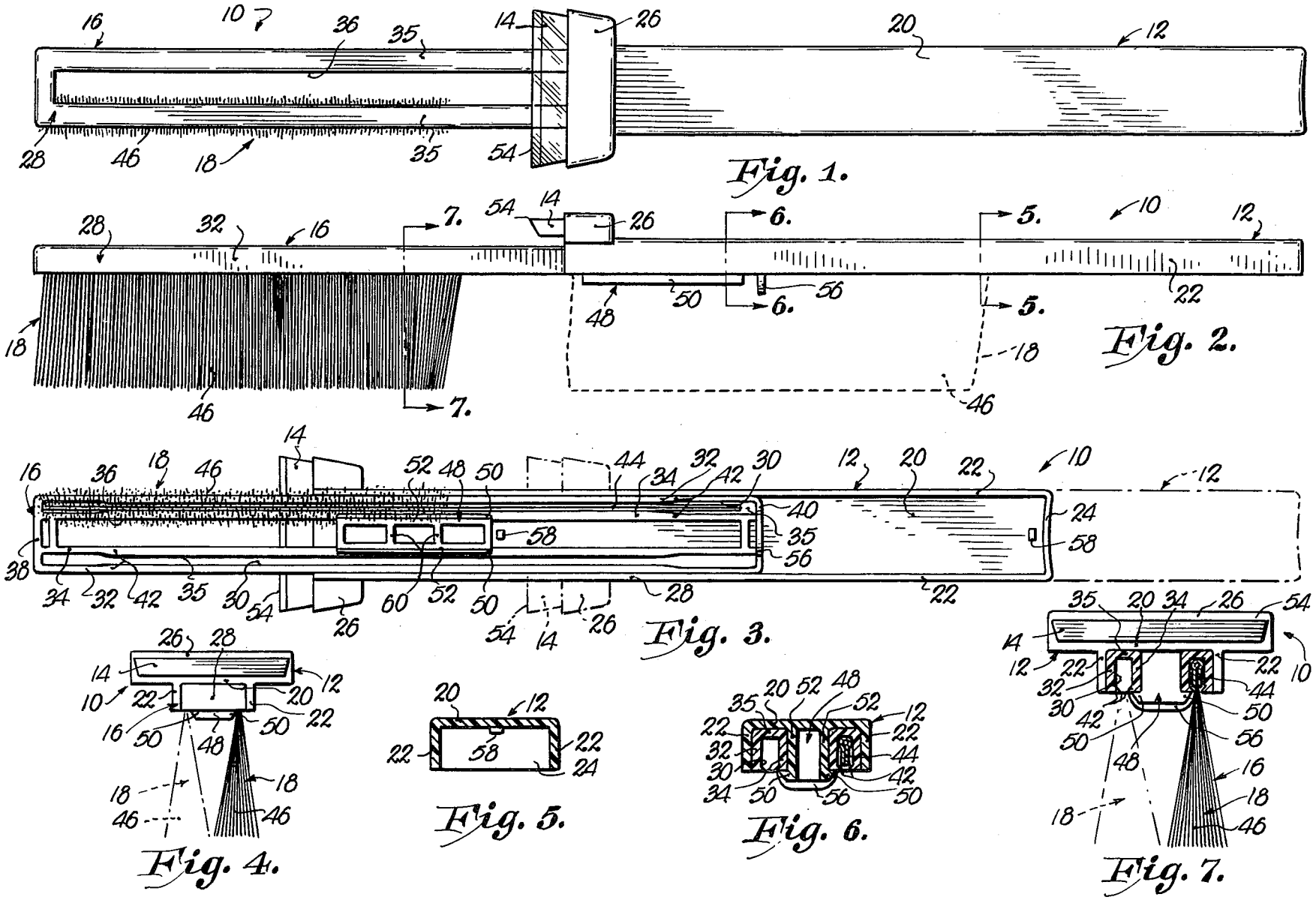
FIG. 1 is a top plan view of the scraping and brushing tool made pursuant to the present invention and illustrating the tool in its extended condition, one of a pair of brush elements of the brush assembly having been removed.
FIG. 2 is a side elevational view of the tool in its extended condition and illustrating, by broken lines, the disposition of the brush assembly when the tool is in its retracted condition.
FIG. 3 is a bottom plan view illustrating the tool in a partially extended condition to reveal details of construction and further illustrating, by irregularly broken lines, the disposition of the scraper and handle relative to the brush assembly when the tool is in a fully extended condition, one of the brush elements again being removed for purposes of clarity.
FIG. 4 is an end elevational view of the tool taken from the scraper and brush end.
FIG. 5 is a cross-sectional view taken along line 5—5 of FIG. 2.
FIG. 6 is a cross-sectional view taken along line 6—6 of FIG. 2.
FIG. 7 is a cross-sectional view taken along line 7—7 of FIG. 2.

An extensible tool, broadly identified by the numeral 10 and defining a combination scraper and brush in an over-under relationship, has an elongate handle 12 provided with a scraper member 14 at one end thereof and an elongate brush assembly 16. Tongue and groove structure integral with the handle 12 and brush assembly 16, as will hereinafter be more fully detailed, interconnects the brush assembly 16 with the handle 12 for reciprocable shiftable movement of the brush assembly 16 longitudinally of the handle 12 between a first retracted position, as shown by broken lines in FIG. 2, and a second extended position in which a pair of brush elements 18 (only one of which is shown) are spaced beyond that end of the handle 12 having the scraper member 14. The extended configuration of the tool 10 is best shown in FIG. 1 as well as by the solid lines in FIG. 2.

The handle 12 presents an inverted, generally U-shaped cross-sectional configuration defined by a top wall 20 and opposed longitudinal sidewalls 22 with an end wall 24 at that end of the handle 12 opposite the scraper member 14. A transversely positioned holder 26 is integrally molded with the top wall 20 and extends thereabove for the purpose of receiving and holding the scraper member 14 for projection beyond the handle 12 and over the proximal open end thereof.

Comprising the brush assembly 16 is an elongate, rectangular brush carrier 28 presenting two brush element receiving, longitudinally disposed and laterally spaced channels 30, each of which is defined by an outer wall 32, an inner wall 34, and a bottom wall 35. The laterally spaced inner walls 34 present a slot 36 extending substantially the full length of the carrier 28, there being end walls 38 and 40 transversely interconnecting the walls 32 and 34 at opposite ends of the carrier 28. Extending generally the full length of each wall 32 and 34, and along their respective distal edges, is an inwardly projecting rib 42. The opposed ribs 42 terminate just short of the end walls 38 and 40.

The brush elements 18 are each comprised of an elongate, clamp-like retainer 44 having a length substantially the same as that of the channels 30. A bristle section 46 is clamped in the retainer 44 and extends longitudinally therealong for a sufficient distance to present a suitable brush. The bristle section 46, however, need not extend the full length of the retainer 44, but may be of any length therealong adequate to effectively provide a brushing action.

Assembly of the scraping and brushing tool 10 is accomplished by initially placing the brush carrier 28 in a telescoping, longitudinally reciprocal relationship with the handle 12 and snap-fitting the two inner walls 34 over an elongate, generally T-shaped block 48 integrally formed in the handle 12 adjacent the open end thereof and disposed longitudinally along the top wall 20 intermediate the sidewalls 22. The inverted, transversely T-shaped configuration is best illustrated in FIG. 7. Extending in opposite directions along the distal longitudinal edges of the block 48 are flanges 50 which snap over the corresponding inner walls 34 of the brush assembly 16. Thus, it will be seen that the slot 36 receives the rectangular block 48 while the walls 32 and 34 of each channel 30 are received between a corresponding wall 22 of the handle 12 and an adjacent longitudinal sidewall 52 of the block 48. Accordingly, it will be seen that the sidewalls 52 of the block 48 and the sidewalls 22 of the handle 12 cooperate to provide an integral guide structure for the reciprocable shifting of the brush assembly 16 between its first, retracted position and its second, extended position while the flanges 50 retain the carrier 28 in engagement with the handle 12.

Upon installation of the carrier 28 the brush elements 18 may then be inserted into their respective channels 30 by simply pressing them thereinto such that the ribs 42 hold the retainers 44 in position. Preferably, the handle 12 and the carrier 28 are of a plastic molded construction in which the walls 22, 32 and 34 have sufficient flexibility to distort when the carrier 28 and brush elements 18 are pressed into place.

In use, the lightweight scraping and brushing tool 10 would normally be in its retracted condition with the brush assembly 16 being in its first position telescopically nested within the handle 12 such that the brush or bristle section 46 is in a disposition represented by the broken lines in FIG. 2. Manifestly, it will be seen that the relatively short length of the tool, when in this condition, lends itself to be conveniently stored in an out-of-the-way place in the automobile or otherwise, and furthermore, places the tool in a condition for use as an ice scraper, it being noted that the length of the bristle section 46 relative to the handle 12 is such that there is sufficient space for the user to grasp the handle. When so used, the tool is rotated in the user's hand such as the bristle section would be located in an upwardly facing direction in order that a leading edge 54 of the scraper member 14 may be utilized to scrape ice from a window.

Furthermore, since it is not at all unusual to place the tool under great stress in chipping away ice, the additional rigidity and strength accorded by the telescoped handle 12 and brush assembly 16 greatly reduces the chance of breakage. Not to be overlooked also is the fact that the brush retainers 44, which are preferably made of metal, serve as additional reinforcing for the tool 10, it being noted that they extend essentially the full length of handle 12.

When the tool 10 is to be used as a brush it is but a simple matter for the user to rotate the tool in his hand and exert a slight pushing pressure with a finger or thumb against an extended tab portion 56 forming a part of the wall 40 of the carrier 28 to shift the same longitudinally of the handle 12 to its extended position as best illustrated in FIGS. 1 and 2. In this position the bristle section 46 is now in a disposition to be used as a brush for sweeping away any loose material that might be on the vehicle, its window or the like. In the event the extended reach of the brush is not needed, mere rotation of the tool in the user's hand will place the bristle section 46 in position to be used in lieu of the scraper member 14.

Detent means is integrally molded on the inner surface of the wall 20 of the handle 12 and intermediate the sidewalls 22, in the nature of two tabs 58 which serve to engage the end wall 40 of the carrier 28 for retention of the same in either its first or second position. The tabs 58 are so constructed and arranged as to interfere with end wall 40 such that the tabs 58 serve to limit the unrestrained reciprocal movement between the handle 12 and the carrier 28. However, the construction of the tabs 58 also permits the latter to pass over the wall 40, notwithstanding the above-mentioned interference, by virtue of slight deformation of the wall 20 when a reasonable manual force is applied to effect further reciprocal movement between the handle 12 and the carrier 28. One tab 58 is spaced adjacent the handle end wall 24 for assisting in retaining the brush assembly 16 in tis first position and the second tab 58 is spaced adjacent block 48 for cooperation therewith in retaining the brush assembly in its second position.

Special attention is directed to the fact that the block 48 is disposed to define a stop for the brush carrier 28 such that there is a partially overlapped relationship longitudinally between the carrier 28 and the handle 12. Furthermore, the elongate nature of the block 48, including a pair of transverse wall sections 60, furnishes a rigidity to the assembly such that axial twisting of the brush assembly 16 relative to the handle 12 when in this extended condition, is substantially precluded. The reinforcement afforded by the metal bristle retainers 44, which also extend into an overlapped condition with the block 48, provide additional rigidity to the assembly.

Therefore, it is manifest that a novel scraper and brush tool has been provided that can be easily stored in an out-of-the-way place when not in use, and yet can be made of sufficient length to be easily used as either a scraper or an extended brush assembly. This has been accomplished through the use of relatively light-weight plastic construction in which low-cost, mass-production molding techniques may be used while still providing the structural strength needed to provide a reliable, lightweight tool that is not easily damaged or broken when used in less than desirable conditions.

Having thus described the invention, what is claimed as new and desired to be secured by Letters Patent is:

1. An extensible scraping and brushing tool of the kind utilized to remove ice and snow from vehicle windows or the like, said tool comprising:

an elongate handle;

a scraper member affixed to said handle at one end thereof;

an elongate brush assembly having at least one brush element proximal an end thereof; and guide structure integral with said handle and said brush assembly interconnecting the latter with said handle for shiftable movement longitudinally relative thereto.

said brush assembly being reciprocable between a first, retracted position relative to said handle in which said brush element is adjacent an end of said handle to a second, extended position relative to said handle in which said brush element protrudes beyond said end of the handle, said brush assembly including an elongate brush carrier slidable along said handle, said handle and said carrier having corresponding, transverse cross-sectional configurations with said carrier being nested within said handle such that their respective longitudinal axes are substantially parallel, said brush carrier including an elongate channel having its longitudinal axis in parallelism with the longitudinal axis of said handle and in which said brush element is received, said channel being of a generally U-shaped configuration having opposed, parallel sidewalls, said sidewalls each having an inwardly projecting flange extending longitudinally along its distal edge such that the flanges are in an opposing relationship, said brush element being press fit into said channel for retention therein by said flanges.

2. A tool as claimed in claim 1, wherein said brush element is comprised of a bristle section and a retainer therefor, said retainer being engageable by said flanges for said retention.

3. A tool as claimed in claim 2, wherein said bristle section is of a length extending only partially along said channel, said retainer extending substantially the full length of said channel.

4. A tool as claimed in claim 1, wherein there is a pair of channels in longitudinally spaced-apart parallelism each of which receives a brush element, said guide structure including a tongue and groove arrangement located intermediate said pair of channels for guiding said brush carrier longitudinally along said handle between said two positions.

* * * * *